US005897302A

United States Patent [19]

Siegel et al.

[11] Patent Number: 5,897,302

[45] Date of Patent: Apr. 27, 1999

[54] RECIPROCATING PISTON PUMP WITH RADIAL CYLINDERS BASED BY A WIRE HOOP SPRING AGAINST AN ECCENTRIC SHAFT

[75] Inventors: Heinz Siegel, Stuttgart; Ernst-Dieter Schaefer, Brackenheim; Guenter Krenz, Steinheim; Dirk Merbold, Eppingen, all of Germany

[73] Assignee: Robert Bosch GmbH, Stuttgart, Germany

[21] Appl. No.: 08/718,582

[22] PCT Filed: Jan. 17, 1996

[86] PCT No.: PCT/DE96/00046

§ 371 Date: Oct. 2, 1996

§ 102(e) Date: Oct. 2, 1996

[87] PCT Pub. No.: WO96/23974

PCT Pub. Date: Aug. 8, 1996

[30] Foreign Application Priority Data

Feb. 3, 1995 [DE] Germany ..... 195 03621

[51] Int. Cl.[6] ..... F04B 1/02

[52] U.S. Cl. ..... 417/521; 417/273; 92/129; 92/138; 92/148; 92/72

[58] Field of Search ..... 417/521, 273; 92/129, 138, 72

[56] References Cited

U.S. PATENT DOCUMENTS

| | | | |
|---|---|---|---|
| 2,271,570 | 2/1942 | Pardee | 103/174 |
| 3,259,074 | 7/1966 | Erdman | 103/174 |
| 3,514,224 | 5/1970 | Budecker | 417/273 |
| 5,573,386 | 11/1996 | Schmitt et al. | 417/521 |
| 5,642,988 | 7/1997 | Zorn | 417/273 |

FOREIGN PATENT DOCUMENTS

| | | |
|---|---|---|
| 1453663 | 3/1969 | Germany . |
| 2243137 | 3/1974 | Germany . |
| 4204631 | 10/1992 | Germany . |

OTHER PUBLICATIONS

Spotts, M.F., Design of Machine Elements, Prentice Hall, pp. 156 and 172 (2 pages only), 1969.

*Primary Examiner*—Charles G. Freay
*Assistant Examiner*—Ehud Gartenberg
*Attorney, Agent, or Firm*—Edwin E. Greigg; Ronald E. Greigg

[57] ABSTRACT

The invention is based on a reciprocating piston pump having two radial pistons disposed symmetrically to one another, which are drivable to a reciprocating motion by an eccentric disposed between them and are held in contact with the eccentric by a hoop spring that engages the pistons. For ease of installation, the invention proposes embodying the hoop spring as a bent wire part, with two open, hooklike eyelets on their ends, which ends are inserted into annular grooves of the pistons and enter into a snap connection with them in order to hold the pistons tightly against the eccentric.

16 Claims, 4 Drawing Sheets

RECIPROCATING PISTON PUMP WITH RADIAL CYLINDERS BASED BY A WIRE HOOP SPRING AGAINST AN ECCENTRIC SHAFT

PRIOR ART

The invention is based on a reciprocating piston pump as set forth hereinafter.

From German Patent Disclosure DE 22 43 137, such a reciprocating piston pump is known, in which two pistons are disposed, facing away from one another, radially to the rotary axis of an eccentric located between them. The pistons are pressed at opposed points against a circumferential face of the eccentric by a C-shaped hoop spring, which is curved around the circumference of the eccentric and whose two ends each engage one piston. For the engagement of the pistons by the hoop spring, the pistons each have a transverse bore, on their ends toward the eccentric, through which the ends of the hoop spring are inserted. The hoop spring is spread open elastically; it is prestressed, and it keeps the pistons in contact with the circumferential face of the eccentric. By rotationally driving the eccentric about its rotary axis, the two pistons are set into a reciprocating motion, in which one piston executes a working stroke at the same time as the other piston executes an intake stroke.

A disadvantage of the known reciprocating piston pump is that the two pistons must be rotated in such a way about their longitudinal axis, for the mounting of the hoop spring, that their through bores will be accessible through an assembly opening for the eccentric in the pump housing so that the ends of the hoop spring can be inserted. The bores of both pistons must also be aligned parallel to one another to allow inserting the hoop spring. Since before the hoop springs are inserted the pistons must be thrust into cylinder bores in the pump housing, only outer face ends of the pistons and on the inside the piston ends protruding into the mounting opening for the eccentric are accessible, making the pistons difficult to grasp so that they can be rotated. After the hoop spring ends have been inserted into the bores of the pistons, the hoop spring must be rotated with the pistons by a quarter turn about the longitudinal axis of the pistons, to allow the eccentric to be mounted in the arc of the hoop spring between the two pistons. Mounting the known reciprocating piston pump is difficult to accomplish and is therefore time-consuming and expensive.

ADVANTAGES OF THE INVENTION

The reciprocating piston pump according to the invention has the advantage that the hoop spring can be mounted in any angular position of the two pistons, and alignment by rotating the pistons about their longitudinal axes becomes unnecessary. The hooklike eyelets are first pressed with their orifices into the annular grooves on the opposed ends of the two pistons, until they snap into place there. The snap connection between the hoop spring and the pistons prevents the hoop spring from coming loose on its own. This enables fast, simple assembly of the reciprocating piston pump of the invention. The hoop spring is a simple bent wire part, which can be produced quickly and inexpensively without wasting material.

In a further feature of the invention, the hoop spring extends past one of its two eyelets. The extension preferably extends approximately tangentially or circumferentially with respect to the eccentric; it lengthens a region of the hoop spring that is curved around the eccentric to beyond the eyelet. Together with a stop face of the pump housing, which is disposed perpendicular to the rotary axis of the eccentric and with little or no spacing from the extension and the curved region of the hoop spring, the extension and the curved region prevent the hoop spring from rotating in the annular grooves of the pistons about their longitudinal axis. At most only a minimal pivoting motion of the hoop spring is possible. As a result, the possibility of a free end of the hoop spring striking an inner wall of the pump housing and wearing away chips from the pump housing in the reciprocating motion is averted. The free end on the eyelet of the hoop spring, which has no extension, does not extend as far as the plane in which the curved region and the extension are located. This securing against relative rotation has the advantage that no special design of the pump housing whatever, or extra securing parts to prevent rotation, are needed. It can therefore be achieved simply and inexpensively.

BRIEF DESCRIPTION OF THE DRAWINGS

The invention is described in further detail below in terms of an exemplary embodiment, which is shown in the drawing. Shown are.

DESCRIPTION OF THE EXEMPLARY EMBODIMENT

Figure 1:
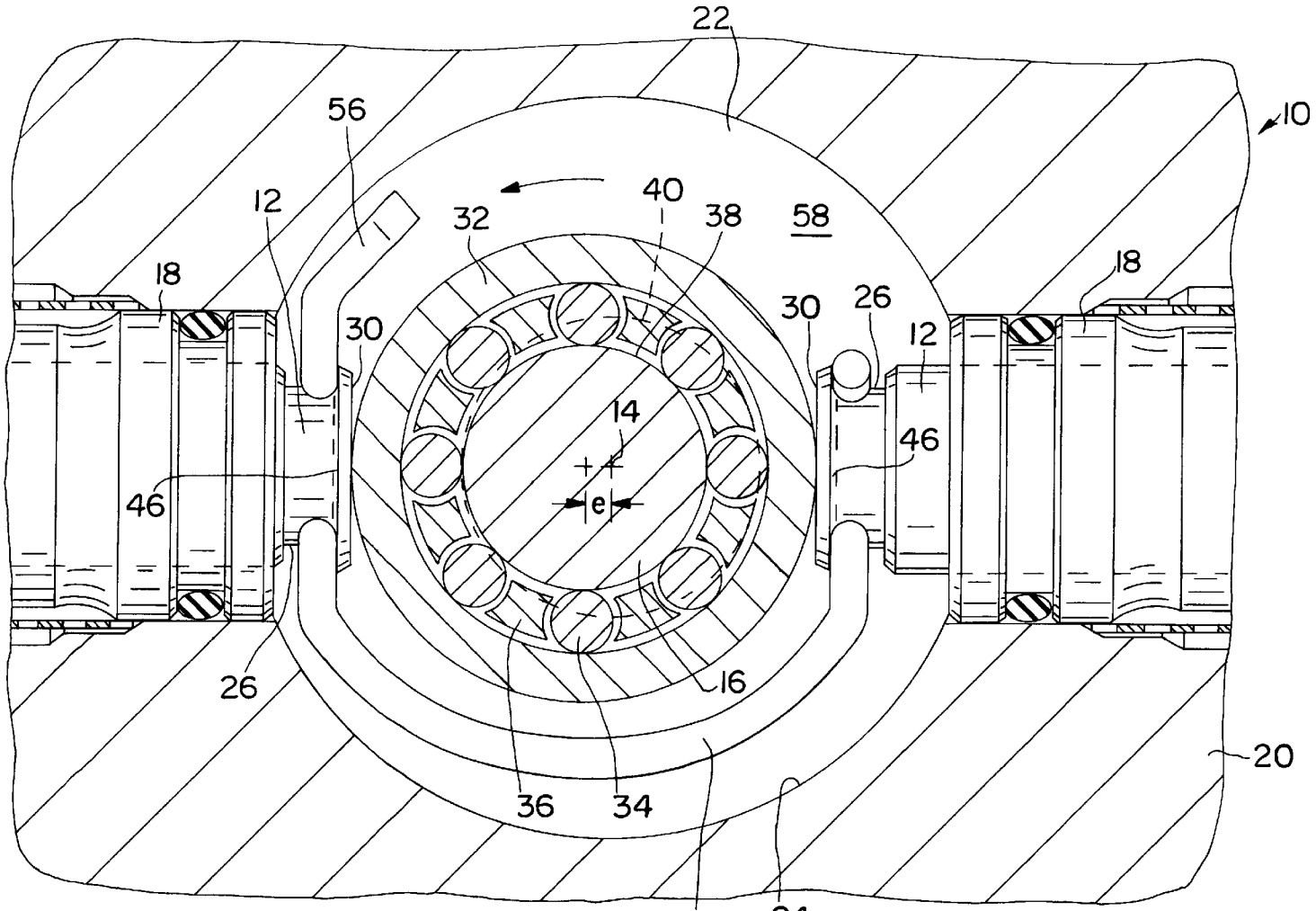
FIG. 1, a section through a reciprocating piston pump of the invention in the region of an eccentric.
Figure 2:
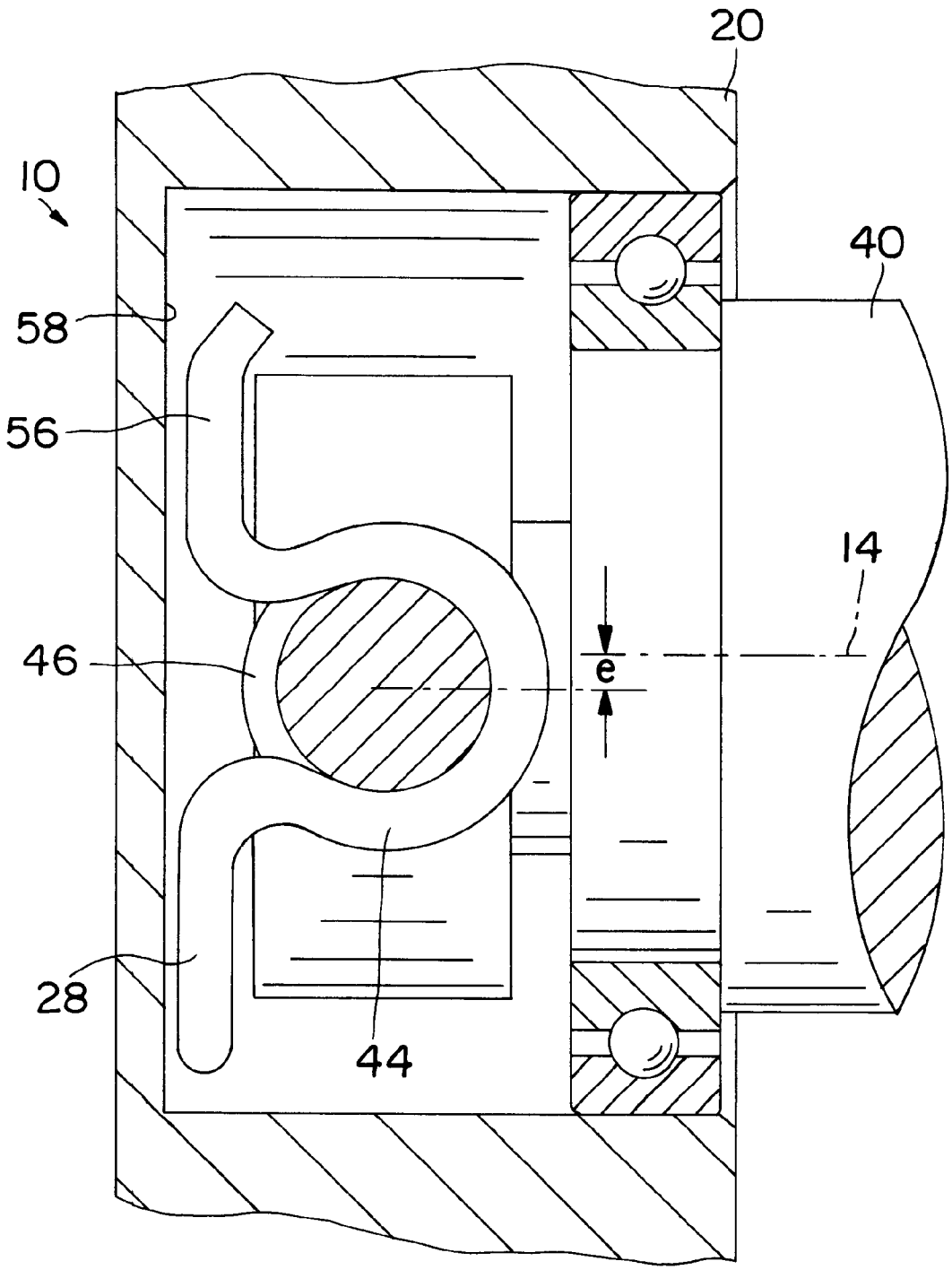
FIG. 2, an axial section through the reciprocating piston pump of FIG. 1.

The reciprocating piston pump 10 of the invention, shown in portions in FIGS. 1 and 2, has two pistons 12, which coaxially and remote from one another are disposed radially to a rotary axis 14 of an eccentric 16 located between them. The two pistons 12 are guided displaceably in cylinders 18 that are inserted into a pump housing 20. Ends facing one another of the pistons 12 protrude from the cylinders 18 into an eccentric chamber 22 in the interior of the pump housing 20. The eccentric chamber 22 is a flat, cylindrical hollow chamber, whose axis, which at the same time is the rotary axis 14 of the eccentric 16, intersects longitudinal axes of the pistons 12 at right angles. The cylinders 18 discharge vertically into a circumferential face 24 of the eccentric chamber 22.

The ends of the pistons 12 that protrude into the eccentric chamber 22 are each provided with an annular groove 26 for access by a hoop spring 28. In the mounted state, as it is shown in FIGS. 1 and 2, this hoop spring 28 is spread elastically open; it is prestressed and presses opposed end faces 30 of the pistons 12 from outside against a circumferential face of a bearing ring 32. The bearing ring 32 is a component of a ball bearing mounted on the eccentric 16. In addition to the bearing ring 32, this ball bearing has bearing balls 34, which are retained by a ball race 36 equidistantly on a cylindrical circumference face 38 of the eccentric 16. This ball bearing arrangement 32, 34, 36 serves to reduce friction between the eccentric 16 and the pistons 12. In FIG. 2, one of the two pistons is shown in section at the groove bottom; the bearing ring 32 and the hoop spring are shown in a front view.

The eccentric 14 is a cylindrical protrusion that is disposed integrally with the eccentric shaft 40 and eccentrically with an eccentricity e on one end. By driving the eccentric shaft 40 to rotate, by means of an electric motor, not shown, the eccentric 16 is driven to execute a rotary motion about its rotary axis 14, which at the same time is the rotary axis of the eccentric shaft 40. Via the bearing balls 34, the eccentric 16 drives the bearing ring 32 to a orbiting motion about the rotary axis 14; the bearing ring 32 is decoupled via the bearing balls 34 from the rotation of the eccentric 16, and the bearing ring 32 does not rotate during its orbiting motion. By its orbiting motion, the bearing ring 32 drives the pistons 12 contacting it so that they reciprocate, and their reciprocating motion represents the working stroke and intake stroke of the pistons 12.

Figure 3:
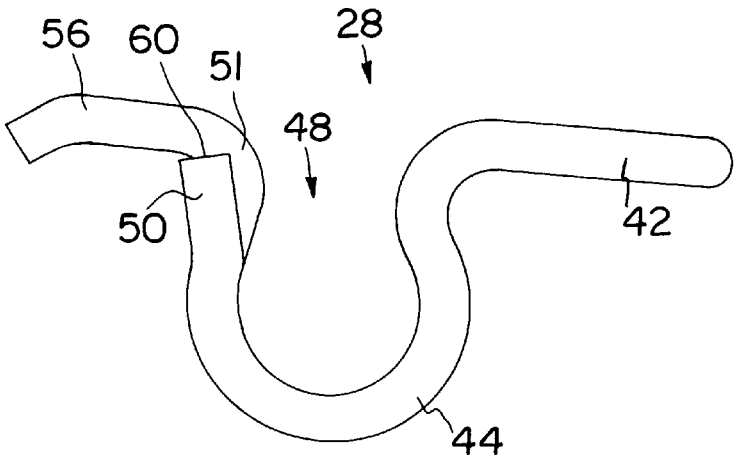
FIG. 3, a hoop spring in plan view.

The hoop spring 28 is shown in FIGS. 2 and 3; FIG. 3 is a view in the direction of the arrow III of FIG. 4 which shows a side view in which the two eyelets 44 are located in planes approximately parallel with each other. The hoop spring 28 is bent from a round spring steel wire. It has a curved region 42, which once the hoop spring 28 is mounted (FIG. 1) curves around the circumference of the eccentric 16.

Figure 4:
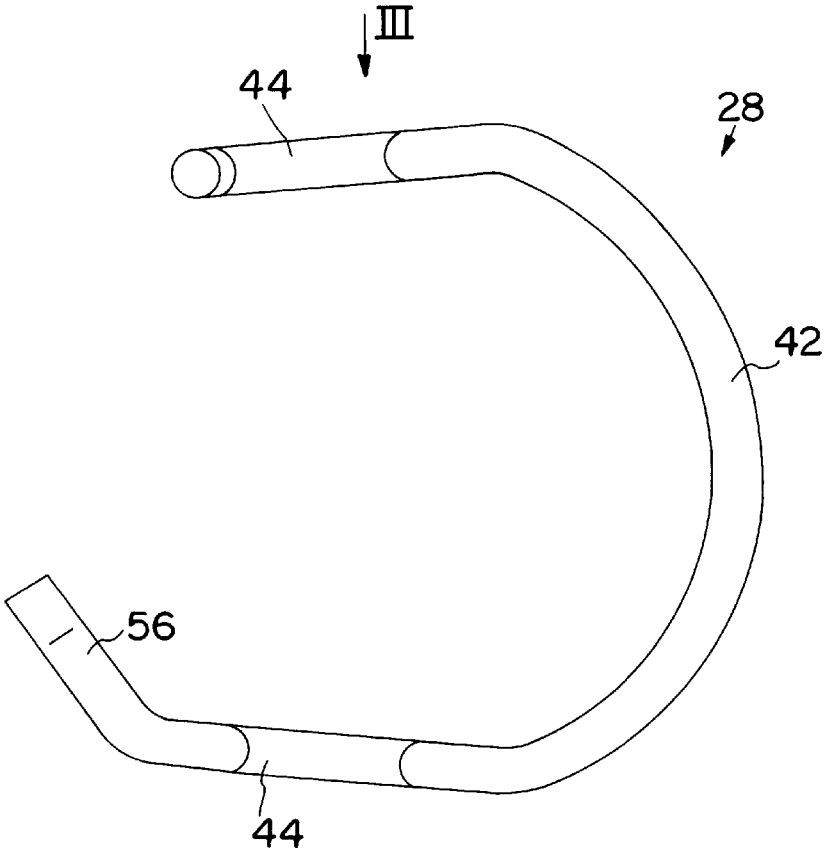
FIG. 4, the hoop spring of FIG. 3 in a front view looking in a direction of the arrow III of FIG. 4.

On both ends of its curved region 42, the hoop spring 28 is bent into hooklike eyelets 44, which are open at one point of their circumference. The eyelets 44 are located in planes that are perpendicular to a plane in which the curved region 42 is located. The two planes in which the eyelets 44 are located are not parallel but rather are inclined somewhat toward one another (FIG. 4). By the elastic spreading apart of the hoop spring 28 upon installation, the two eyelets 44 are then parallel to one another (FIG. 1). In the plan view on the hoop spring 28 (FIG. 3), the eyelets 44 are bent approximately at right angles to the curved region 44, so that the eyelets 44 open in the direction of the plane in which the curved region 42 is located. The two eyelets 44 rest one above the other coincidently. They have a circular arc shape; their inside diameter is somewhat larger than a diameter at the groove bottom of the annular groove 26 of the pistons 12. As a result, the eyelets 44 of the hoop spring 28 rest on a groove side 46 of the annular groove 26 that is adjacent to the bearing ring 32. This groove side 46 is embodied spherically. This has the advantage that the eyelets 44, despite unavoidable errors in shaping of the hoop spring 28, rest uniformly on the groove side 46.

The inside clearance at an orifice 48, which is the narrowest point of the open eyelets 44, is smaller than the diameter of the pistons 12 at the bottom of the annular groove 26, and as a result the eyelet 44, on being inserted into the annular groove 26, first spreads elastically open and then snaps into place and can no longer come loose on its own. For easier insertion of the eyelet 44 into the annular groove 26, one free end of the eyelet 44 is embodied as a threading-in portion 50, 51, in the region of which the inside clearance increases from the orifice 48 outward. The threading-in portion 50, 51 serves to position the hoop spring 42 for introducing its eyelets 44 into the annular grooves 26 of the pistons 12, and it reinforces the elastic spreading apart of the eyelets 44.

At one of the two eyelets 44, the hoop spring 28 has an extension 56 that is integral to it, on its side remote from the curved region 42. This extension is located in the same plane as the curved region 42 and extends some distance approximately in the circumferential direction of the eccentric 16. An end wall 58 of the pump housing 20 that defines the eccentric chamber 22 is located tightly against the curved region 42 and the extension 56 of the hoop spring 28. The end wall, forming a stop face 58, prevents the hoop spring 28 from being able to rotate in the annular groove 26 of the pistons 12, and allows only a slight pivoting motion (FIG. 2). As a result, a free end 60 of the eyelet 44 of the hoop spring 28, this eyelet not having an extension, is prevented from striking the end wall 58 of the pump housing 20 and removing chips in the reciprocating motion of the pistons. This free end 60 does not extend as far as the plane in which the curved region 42 and the extension 56 of the hoop spring 28 are located (FIG. 3).

For assembly of the reciprocating piston pump 10 of the invention, the pistons 12 are thrust from outside into the cylinders 18, after the cylinders have been inserted in the pump housing 20. The pistons 12 are thrust far enough into the cylinders 18 that their ends toward one another protrude into the eccentric chamber 22, and their annular grooves 26 are spaced apart from one another by a distance that corresponds to the spacing of the two eyelets 44 of the hoop spring 28 in the relaxed state. Next, the hoop spring 28, with the orifices 48 of its eyelets 44 leading, is pressed into the annular grooves 26, until the eyelets 44 snap into place in the annular grooves 26. The curved region 42 of the hoop spring 28 extends laterally at this time and does not hinder the assembly.

For the subsequent mounting of the eccentric shaft 40 to the eccentric 16 that carries the ball bearing 32, 34, 36, the pistons 12 must be pressed apart, counter to the force of the hoop spring 28, such that the bearing ring 32 can be placed between the end faces 30 toward one another of the pistons 12. For pressing the pistons 12 apart, the side of the bearing ring 32 remote from the eccentric shaft 40 may be embodied conically; as a result, on insertion of the eccentric shaft 40 into the pump housing 20, which takes place in the direction of the rotary axis 14 of the eccentric shaft 40, the bearing ring 32 presses the pistons 12 apart.

Figure 5:
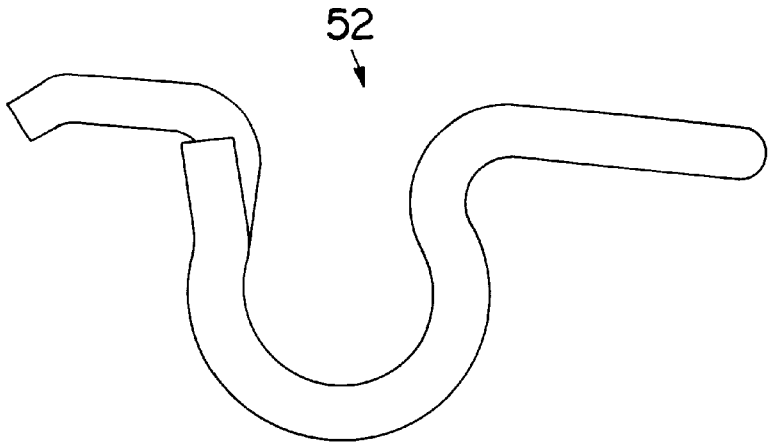
FIG. 5, a second embodiment of a hoop spring in plan view.
Figure 6:
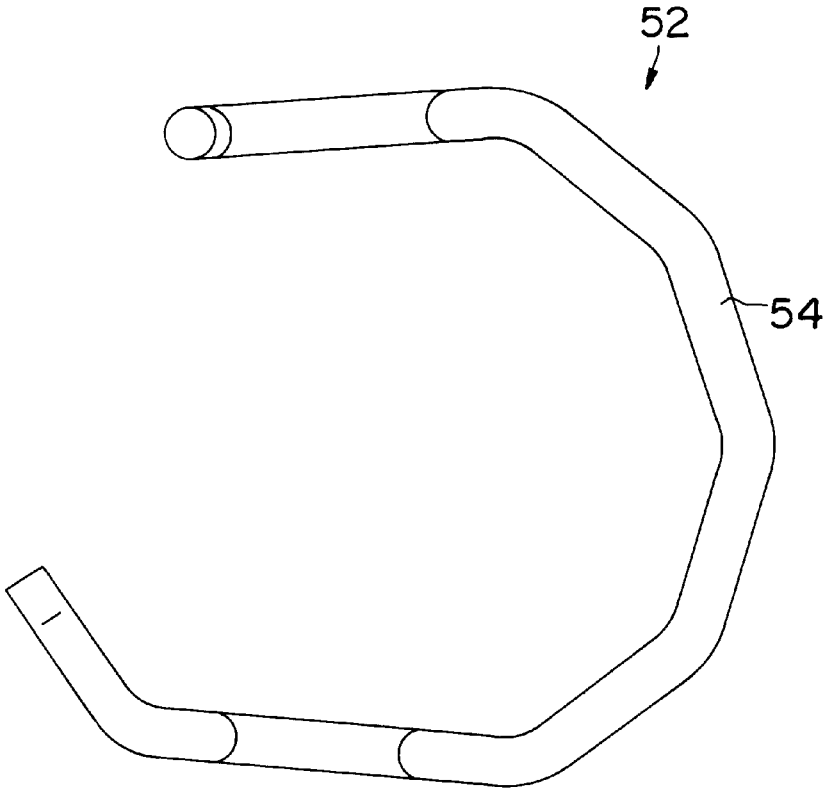
FIG. 6, the hoop spring of FIG. 5 in a front view.

FIGS. 5 and 6 show a version of a hoop spring 52 that is modified over FIGS. 3 and 4. A curved region 54 of this hoop spring 52 is shaped into a polygonal course instead of that of a continuous arc. Otherwise, this hoop spring 52 is embodied identically to the hoop spring 28 already described. For this reason, the hoop spring 52 will not be described again here, and the remarks made about the hoop spring 28 shown in FIGS. 3 and 4 apply. The hoop spring 52 shown in FIGS. 5 and 6 can be inserted into the reciprocating piston pump 10 instead of the hoop spring 28 shown in FIGS. 3 and 4. This second embodiment of the hoop spring 52 has the advantage that close production tolerances can be better adhered to.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A reciprocating piston pump, comprising a pump housing in which two pistons are disposed opposite one another, approximately radially to a rotary axis of an eccentric (16) that is driven by a shaft to rotate between opposite ends of said two pistons, and having a hoop spring curved from a piece of wire, said hoop spring has a cross-section which is cylindrical and is curved in a circumferential direction around at least one-half of a diameter of the eccentric and said hoop spring has two ends which form eyelets (44), said two ends of said hoop spring engages annular grooves (26) in opposite end portions of the two pistons oriented toward the eccentric and presses the piston ends against a circumferential face of the eccentric, said annular grooves (26) have groove side faces (46) adjacent to the eccentric (16) which are curved in convex fashion and are embodied somewhat spherically, the two ends of the hoop spring (28, 52) are embodied as hooklike, open eyelets (44), which engage the annular grooves (26) of the pistons (12), embracing a groove bottom thereof, and said two ends of the hoop spring have openings (48) having an inside inner diameter which is slightly larger than a diameter of the piston at a bottom of the groove.

2. The reciprocating piston pump in accordance with claim 1, in which the hoop spring (28, 52), on one of its two eyelets (44), on a side of the eyelet (44) remote from a region (42, 54) of the hoop spring (28, 52) that is curved around the eccentric (16), has an extension (56) which is located in or nearly in the same plane as the curved region (42, 54), and that the pump housing (20) has a stop face (58), disposed approximately perpendicular to a rotary axis (14) of the eccentric (16), which stop face is spaced apart at most by a small distance from the curved region (42, 54) and the extension (56) of the hoop spring (28, 52).

3. The reciprocating piston pump in accordance with claim 1, in which the openings (48) are oriented approximately parallel to a plane in which the curved region (42; 54) of the hoop spring (28; 52) is located.

4. The reciprocating piston pump in accordance with claim 2, in which the openings (48) are oriented approximately parallel to a plane in which the curved region (42; 54) of the hoop spring (28; 52) is located.

5. The reciprocating piston pump in accordance with claim 1, in which beyond the openings (48) that form a narrowest point, the eyelets (44) merge with a widening threading-in portion (50).

6. The reciprocating piston pump in accordance with claim 2, in which beyond the openings (48) that form a narrowest point, the eyelets (44) merge with a widening threading-in portion (50).

7. The reciprocating piston pump in accordance with claim 3, in which beyond the openings (48) that form a narrowest point, the eyelets (44) merge with a widening threading-in portion (50).

8. The reciprocating piston pump in accordance with claim 1, in which the curved region (54) is bent polygonally.

9. The reciprocating piston pump in accordance with claim 2, in which the curved region (54) is bent polygonally.

10. The reciprocating piston pump in accordance with claim 3, in which the curved region (54) is bent polygonally.

11. The reciprocating piston pump in accordance with claim 5, in which the curved region (54) is bent polygonally.

12. The reciprocating piston pump in accordance with claim 1, in which when the hoop spring (28; 52) has been installed, the two eyelets (44) are located in two planes approximately parallel to one another.

13. The reciprocating piston pump in accordance with claim 2, in which when the hoop spring (28; 52) has been installed, the two eyelets (44) are located in two planes approximately parallel to one another.

14. The reciprocating piston pump in accordance with claim 3, in which when the hoop spring (28; 52) has been installed, the two eyelets (44) are located in two planes approximately parallel to one another.

15. The reciprocating piston pump in accordance with claim 5, in which when the hoop spring (28; 52) has been installed, the two eyelets (44) are located in two planes approximately parallel to one another.

16. The reciprocating piston pump in accordance with claim 8, in which when the hoop spring (28; 52) has been installed, the two eyelets (44) are located in two planes approximately parallel to one another.

* * * * *